US007274337B2

(12) United States Patent
Takakura

(10) Patent No.: US 7,274,337 B2
(45) Date of Patent: Sep. 25, 2007

(54) ANTENNA STRUCTURE AND WAVE CLOCK HAVING THE ANTENNA STRUCTURE, AND METHOD FOR MANUFACTURING THE ANTENNA STRUCTURE

(75) Inventor: Akira Takakura, Chiba (JP)

(73) Assignee: Seiko Instruments Inc. (JP)

( * ) Notice: Subject to any disclaimer, the term of this patent is extended or adjusted under 35 U.S.C. 154(b) by 50 days.

(21) Appl. No.: 11/341,758

(22) Filed: Jan. 27, 2006

(65) Prior Publication Data

US 2006/0176230 A1 Aug. 10, 2006

(30) Foreign Application Priority Data

Feb. 1, 2005 (JP) ..... 2005-025555

(51) Int. Cl.
*H01Q 7/08* (2006.01)

(52) U.S. Cl. ..... 343/788; 343/718; 343/787; 29/600

(58) Field of Classification Search ..... 343/788, 343/787, 718; 29/600; 368/47
See application file for complete search history.

(56) References Cited

U.S. PATENT DOCUMENTS 6,134,188 A * 10/2000 Ganter et al. ..... 368/47

2005/0018543 A1* 1/2005 Fujisawa ..... 368/47

* cited by examiner

*Primary Examiner*—Hoang V. Nguyen
(74) *Attorney, Agent, or Firm*—Adams & Wilks

(57) ABSTRACT

An antenna structure that can be received in a case in a condition that an occupied space is minimized, and allows reception of an electric wave at excellent sensitivity, and a wave clock having the antenna structure, and a method for manufacturing the antenna structure are provided. An antenna structure of a wave clock has an arcuately curved, soft-magnetic magnetic core member, and a coil wound on the center in an extending direction of the magnetic core member, and is received in a case. In the antenna structure, the magnetic core member has outer circumferential surfaces at at least one of ends exposed from the coil, the surfaces extending non-arcuately such that it is situated at more inner circumferential side as it approaches a tip. The arcuately curved, magnetic core member is formed by laminating plural sheets of soft magnetic, thin leaves and the soft magnetic, thin leaf at an inner circumferential side is large in circumferential length compared with the soft magnetic, thin leaf at an outer circumferential side. The soft magnetic, thin leaves are formed by laminating plural sheets of soft magnetic foils respectively.

9 Claims, 8 Drawing Sheets

CROSS SECTION ALONG 1C-1C

CROSS SECTION ALONG 1D-1D

Fig. 3A
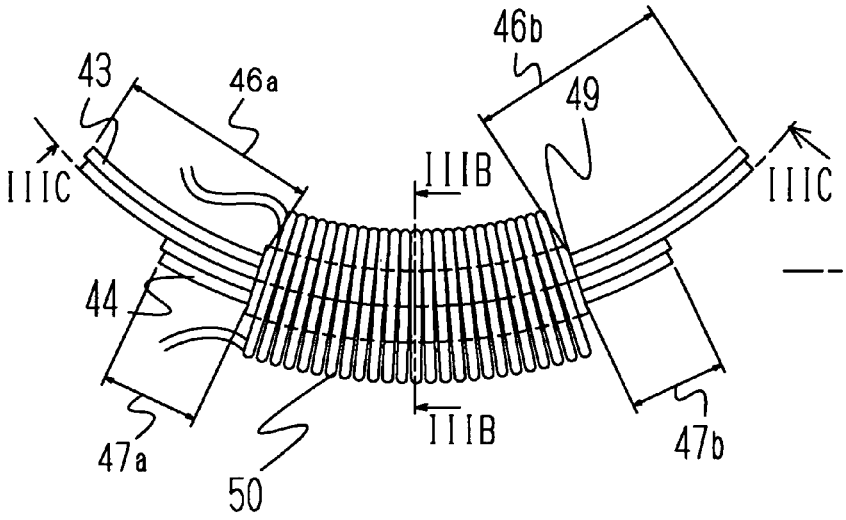
Fig. 3B
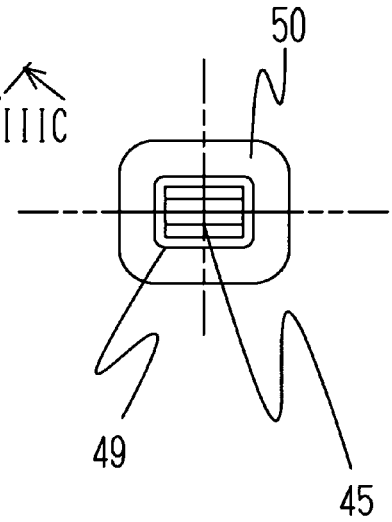
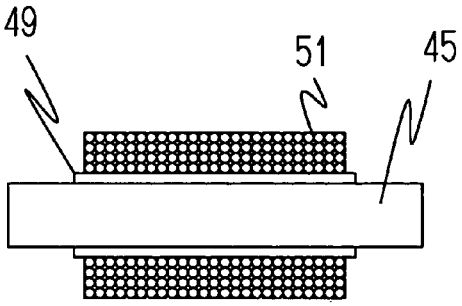
Fig. 3C

ANTENNA STRUCTURE AND WAVE CLOCK HAVING THE ANTENNA STRUCTURE, AND METHOD FOR MANUFACTURING THE ANTENNA STRUCTURE

BACKGROUND OF THE INVENTION

1. Field of the Invention

The present invention relates to an antenna structure, and a wave clock having the antenna structure, and a method for manufacturing the antenna structure.

2. Description of the Prior Art

It has been proposed that plural sheets of foils having the same shape and size, which comprise an amorphous soft magnetic material, are laminated to form a laminated body, and the laminated body is covered with an electrically insulative film, and then a wire is wound thereon to form a coil, thereby an antenna structure for a wave clock is manufactured (JP-A-2003-110341).

However, when the antenna structure having a generally straight and rod-like shape is tried to be received in a typically circular, clock case, it is hard to be received efficiently.

It is also proposed that such an antenna structure is arcuately formed.

However, even in the case of the proposed antenna structure, when the arcuate antenna is disposed close to an inner circumferential surface of a circular case, ends and ears of the antenna where magnetic flux for detection comes in and out are situated close to the case similarly as the center of the antenna formed by winding the coil, as a result effective reception of an electric wave may be obstructed by the case. If the straight antenna structure is tried to be received into the case, the problem is more significant.

The invention, which was made in the light of the above points, aims to provide an antenna structure which is received in a case in a condition that an occupied space is minimized and allows reception of an electric wave at excellent sensitivity, and a wave clock having the antenna structure, and a method for manufacturing the antenna structure.

SUMMARY OF THE INVENTION

To achieve the object, the antenna structure of the invention has an arcuately curved soft magnetic, magnetic core member, and a coil wound on the center in an extending direction of the magnetic core member, and is received in a case; wherein the magnetic core member has an outer circumferential surface at at least one of ends exposed from the coil, the surface extending non-arcuately such that it is situated at a more inner circumferential side as it approaches a tip.

In the antenna structure of the invention, since "the magnetic core member has the outer circumferential surface at at least one of the ends exposed from the coil as ears of the antenna, the surface extending non-arcuately such that it is located at the more inner circumferential side as it approaches the tip", the outer circumferential surface of the exposed end (ear of the antenna) can be situated with a longer distance from an inner circumferential surface of the case as it approaches the tip, therefore magnetic flux that comes in and out of the magnetic core member through the outer circumferential surface may be hard to be obstructed by presence of the case. Therefore, surface area can be increased by lengthening the exposed end (ear of the antenna); consequently reception sensitivity of the antenna can be improved to the maximum.

In the antenna structure, since the center on which the coil is wound has a large cross section area compared with the exposed end (ear), the center having the coil wound thereon can be kept in a condition where the magnetic flux at the maximum can pass therethrough, therefore the sensitivity of the antenna and an antenna characteristic can be kept high.

Moreover, in the antenna structure of the invention, since "the magnetic core member has the outer circumferential surface at at least one of the ends exposed from the coil (ears of the antenna), the surface extending non-arcuately such that it is situated at the more inner circumferential side as it approaches the tip", an area between an inner wall of the case and the outer circumferential surface formed by the retraction of the outer circumferential surface from the circular arc can be used for providing fixing members (for example, screws) of the antenna structure, therefore the antenna structure can be easily fixed, increasing the degree of freedom of a planar layout of related components including the antenna structure.

Here, while the inner circumferential surface of the case typically has a planar shape of round, in some cases, it may have other shapes of closed curves such as ellipse and oval, and for example, may have a shape of square having smoothly curved corners. Regarding the soft magnetic, magnetic core member, the term "arcuate" means that the member has a shape substantially or approximately similar to the inner circumferential surface of the case to which the member is opposed at the outer circumference such that a distance from the inner circumferential surface of the case is substantially constant, and for example, when the inner circumferential surface of the case has a shape of round, it means that the outer circumference has a shape of circular arc that is substantially similar to a circular arc forming part of the round and small in radius of curvature, and when the inner circumferential surface of the case is elliptic, it means that the outer circumference has a shape of circular arc that is substantially similar to an arcuate portion forming part of the ellipse. Naturally, the outer circumference need not have exactly similar shape. Furthermore, when the inner circumferential surface of the case has the square shape having the smoothly curved corners, similarly, it means that the outer circumference has a shape of arc approximately similar to a portion of the square shape to which the outer circumference is opposed.

While the portion "having the outer circumferential surface which extends non-arcuately such that it is situated at the more inner circumferential side as it approaches the tip" is typically both ends exposed from the coil of the magnetic core member, it may be only one end, if desired.

In such an outer circumferential surface of the exposed end, "extending non-arcuately such that it is situated at the more inner circumferential side as it approaches the tip" may be achieved by either of a continuously and smoothly, tapered shape, or a stepwise tapered shape. As described below, when a laminated body of thin leaves is used for the soft magnetic, magnetic core member, the stepwise tapered shape is formed.

While the soft magnetic, magnetic core member may be formed by integral forming and the like, it typically comprises the laminated body formed by laminating plural sheets of soft magnetic, thin leaves. In that case, length in a circumferential direction of the soft magnetic, thin leaf at an outer circumferential side is made to be equal to or smaller than that of the soft magnetic, thin leaf at an inner circumferential side, thereby a shape of the member is generally formed in the stepwise tapered shape such that the outer circumferential surface is situated at the more inner circumferential side as it approaches the tip. In this way, each of the soft magnetic, thin leaves to be laminated forms a soft magnetic, magnetic core part configuring the soft magnetic, magnetic core member. The number of sheets of the soft magnetic, thin leaves having different length each may be at least three, or may be further more, as long as it is two or more. Here, the thin leaves are plural sheets of leaves to be laminated in order to configure the magnetic core member, each of them being thinner than the magnetic core member, and the leaves themselves may be comparatively thick.

When the magnetic core member is formed by laminating the thin leaves, it is easily curved arcuately about an axis perpendicular to a laminating direction, and eddy-current loss can be reduced.

While the soft magnetic, thin leaf itself may be an integrally formed, soft-magnetic material body, it is typically formed by laminating plural sheets of soft magnetic foils. Here, the soft magnetic foil is a foil that is thinner than the thin leaf such that it is easily curved arcuately. In other words, the thin leaf is a leaf having a thickness corresponding to thickness of plural sheets of foils laminated, and the leaf itself may be comparatively small in thickness.

When the magnetic core member is formed by laminating the thin leaves, in addition, the thin leaf is formed by laminating the foils, the member is easily curved arcuately about the axis perpendicular to the laminating direction, and the eddy-current loss can be reduced.

While the soft magnetic material body typically comprises an amorphous material (for example, soft magnetic amorphous material known as METGRAS (trade name) 2705 or METGRAS 2714 (trade name)) that has an excellent soft magnetic characteristics and mechanical strength (compared with sintered ferrite and the like), if desired, it may comprise a soft magnetic alloy such as Permalloy, or other kinds of soft magnetic materials. When the magnetic core member is formed by laminating the thin leaves, in addition, the thin leaf is formed by laminating the foils, even if the member comprises a comparatively hard material, it is easily curved arcuately about the axis perpendicular to the laminating direction with internal stress being minimized.

When the antenna structure is manufactured, that is, in the manufacturing method of the invention, typically, a wire is wound on a central portion (portion near the center compared with the tapered end at a side as the outer circumference) in a longitudinal direction of the laminated body of thin leaves having different length each to form the coil, then the laminated body is curved arcuately such that a thin leaf having small length is situated at the outer circumferential side, and then the curved, laminated body is annealed.

Here, since the laminated body is curved after forming the coil rather than winding the wire in a coil pattern on the curved portion, a winding condition of the coil having less unevenness in winding is easily realized. Moreover, since the laminated body is annealed after being curved, reduction in soft magnetic characteristic in accordance with strain occurring during cutting the soft magnetic material into a form of thin leaves (or further leaf-like thin body) can be recovered. Strain occurring during curving can be similarly reduced to a minimum. Even if the foils brittle by annealing, since the foils are integrated in the laminated condition during annealing, possibility of breakage due to embrittlement can be suppressed to a minimum.

In the manufacturing method of the antenna structure of the invention, typically, after the laminated body was enclosed in an electrically insulative tube, or after an electrically insulative adhesive was coated on the laminated body, the wire is wound in the coil pattern. In the case of the latter, typically, a thermosetting adhesive is coated on the laminated body, and then the body is covered with an electrically insulative film. The thermosetting adhesive may be coated on the coil.

As a result, in the manufacturing method of the antenna structure of the invention, fixing or stabilization of the laminated body or the coil due to thermal shrinkage of the tube or curing or solidification of the adhesive can be realized at the same time during annealing.

The antenna structure of the invention is typically used as a reception antenna for receiving a standard electric wave including time information, and a clock having the antenna structure employs a construction of a wave clock (wave correction clock) in which time is corrected according to the time information from the standard electric wave.

The antenna structure may be a structure that works as a transmission antenna instead of the reception antenna, or may be a structure that works as an antenna for combined use of transmission and reception.

BRIEF DESCRIPTION OF THE SEVERAL VIEWS OF THE DRAWINGS

A preferred form of the present invention is illustrated in the accompanying drawings in which:

FIG. 1A is a drawing for illustrating a preferred example of a wave clock of according to the invention, wherein FIG. 1A is a plane, explanatory drawing in a condition of omitting a back cover from a wave clock of FIG. 1B.

FIG. 3 are drawings showing a magnetic core member in an exaggerated and expanded manner in a thickness direction, wherein FIG. 3A is a plane, explanatory drawing, FIG. 3B is a cross sectional, explanatory drawing along a line 111B-IIIB of FIG. 3A, and FIG. 3C is a cross sectional, explanatory drawing along a line IIIC-IIIC in a longitudinal direction (circulate arc direction) of FIG. 3A;

FIG. 5 are drawings showing a manufacturing method (procedure) of the magnetic core member, wherein

DETAILED DESCRIPTION OF THE PREFERRED EMBODIMENTS

A preferred embodiment of the invention will be described according to a preferred example shown in accompanying drawings.

Figure 1A:
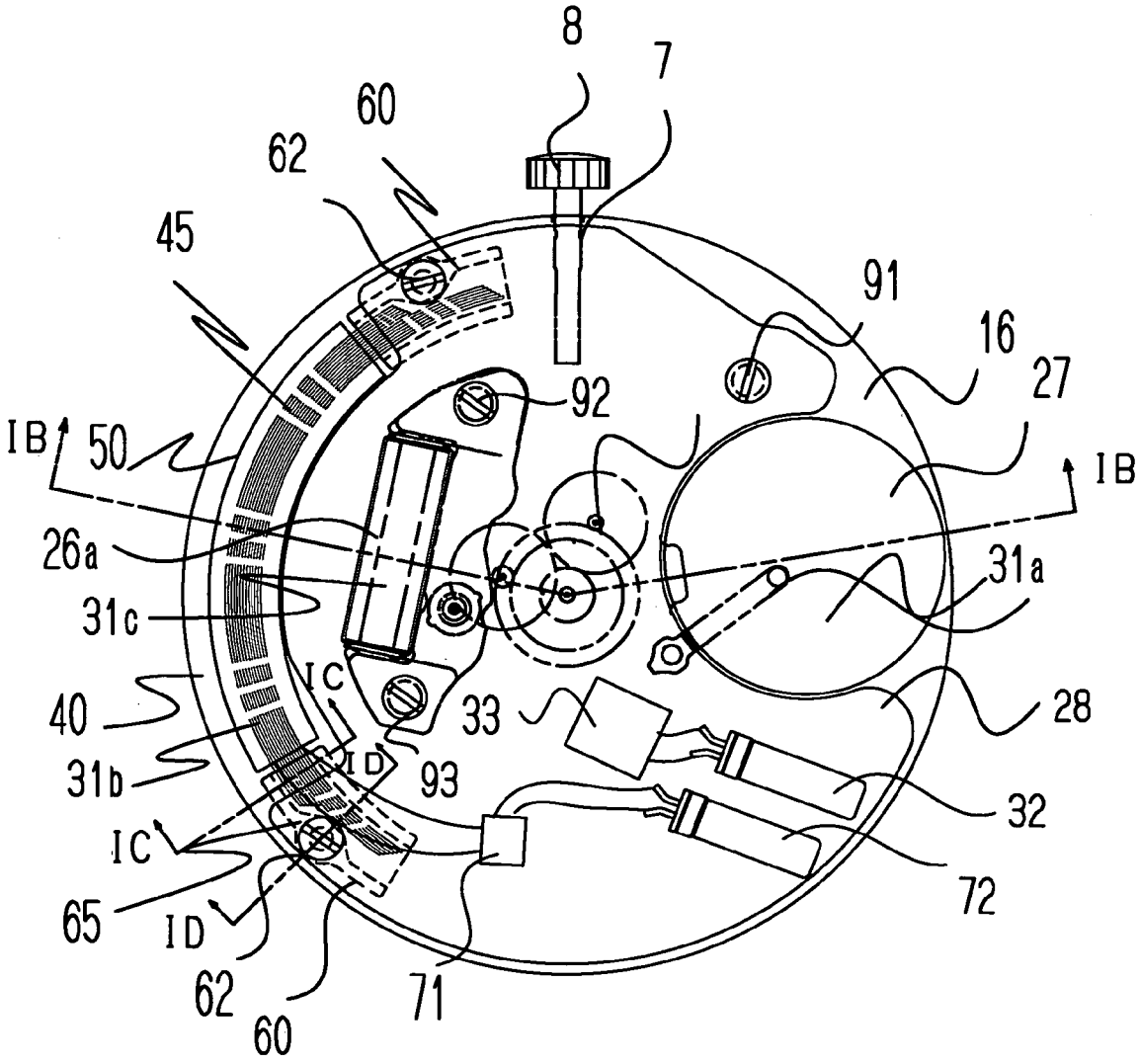
Figure 1B:
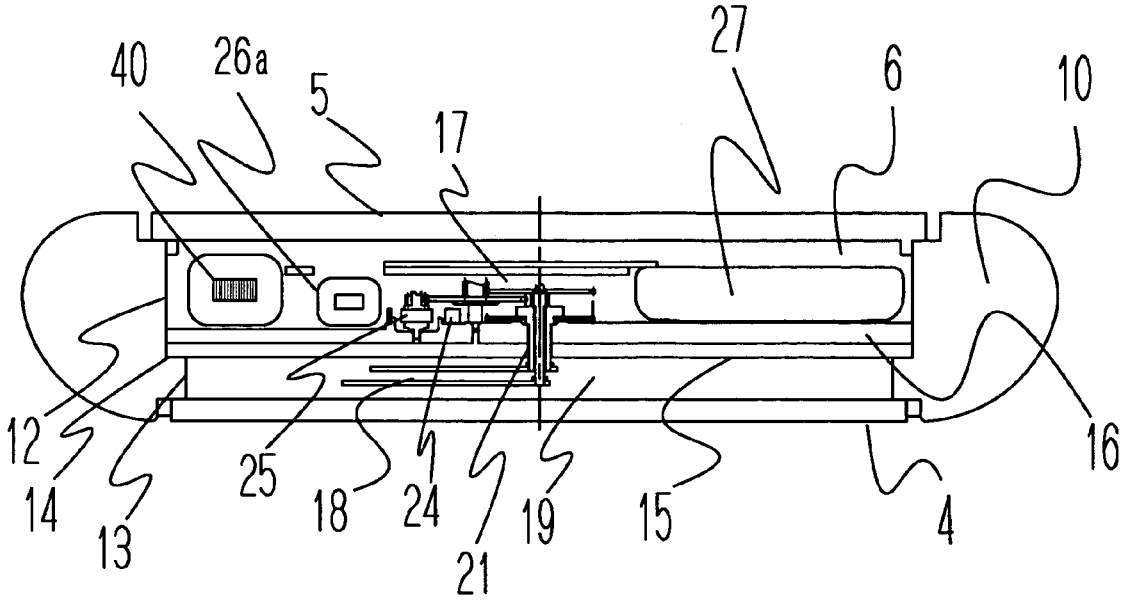
FIG. 1B is a cross sectional, explanatory drawing along a line IB-IB of FIG. 1A, FIG. 1C a cross sectional, explanatory drawing along a line IC-IC of FIG. 1A.
Figure 1C:
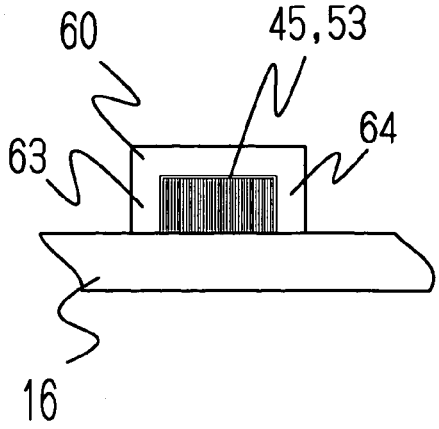
Figure 1D:
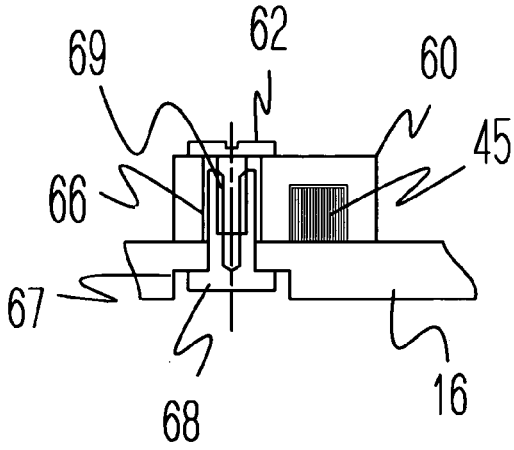
FIG. 1D is a cross sectional, explanatory drawing along a line ID-ID of FIG. 1A.
Figure 2:
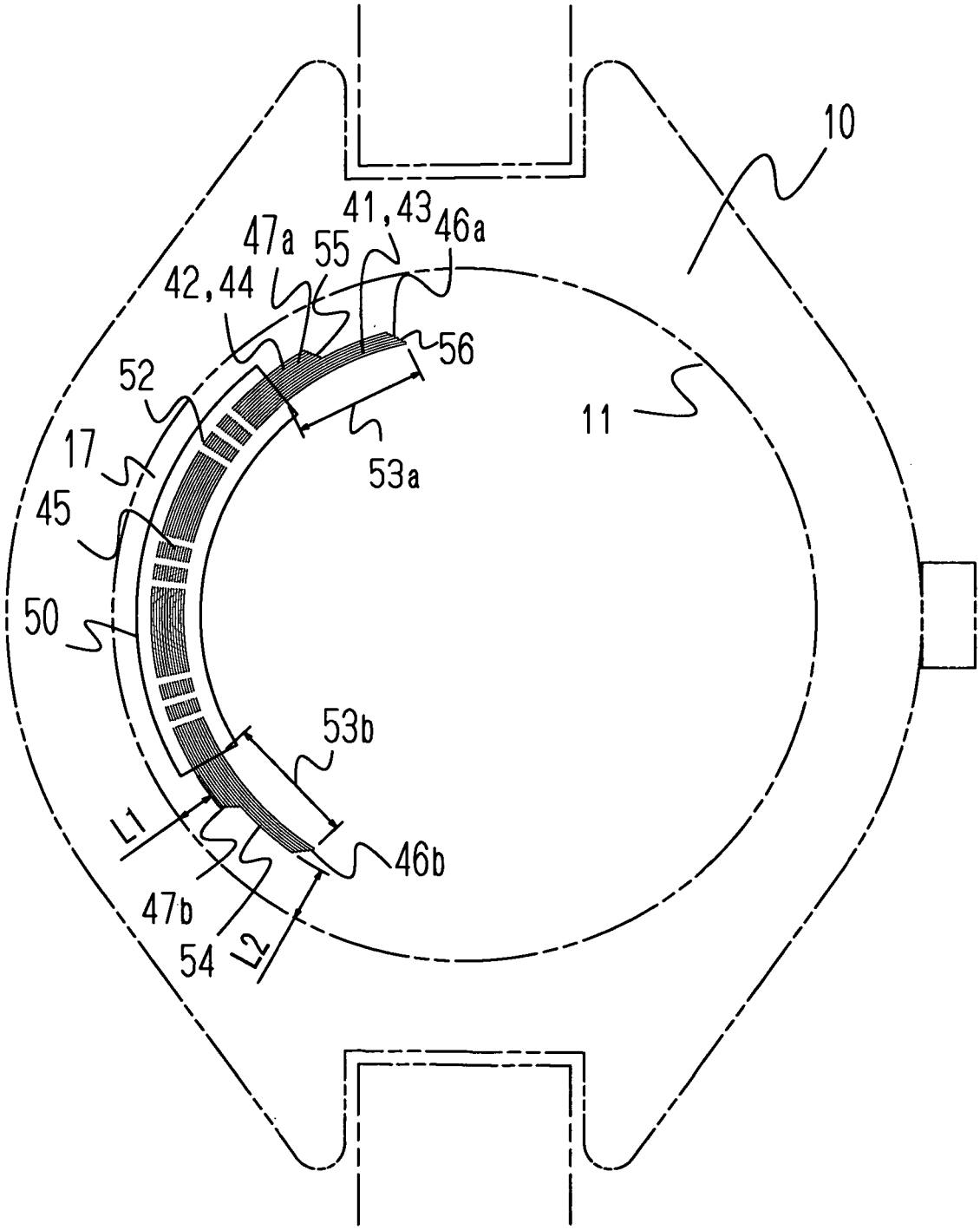
FIG. 2 is a plane, explanatory drawing showing a condition where an antenna is disposed in the clock of FIG. 1 using a relation of the antenna to a case.

FIG. 1 and FIG. 2 show a wave clock 1 of the preferred embodiment of the invention. As shown in an image line in FIG. 2, the clock has a case 10 comprising a nonmagnetic metal material having a circular, planar shape of an inner circumferential surface 11. As shown in FIG. 1B, an approximately cylindrical opening 3 of the case 10 is closed by a glass 4 and a resin back cover 5 at a side opposite to the glass, thereby formed into a room 6 for receiving various clock components. 7 is a winding core, and 8 is a crown.

As shown in FIG. 1, at a step 14 between a large-diameter cylindrical portion 12 and a small-diameter cylindrical portion 13 of the case 10, a dial plate 15 comprising a nonmagnetic metal material and a resin base plate 16 are placed, and partition the room 6 in the case 10 into a room 17 for receiving various drive components and a room 19 for receiving various pointers 18. The base plate 16 has, for example, an outer circumferential surface 16*a* that has a circular shape approximately similar to a shape of an inner circumferential surface 17*a* of the room 17 of the case 10.

At the center of the base plate 16, various coaxial bodies or shafts 21 penetrate along a center axis C, and respective bodies 21 to which respective pointers 18 are attached at ends projecting into the room 19 are coupled with one another by various gears around the bodies 21 in the room 17, and thus generally form a clock train 22. Most of the various gears configuring the train 22 are supported in a freely rotatable manner between the base plate 16 and a train receiver mounted to the base plate 16 at an interval.

Near the train 22 distributed about the center axis C, a motor 26 including a stator 24 and a rotor 25 is attached to the base plate 16 by screws 92, 93, and a button battery 27 is disposed at a side opposite to the stator 24 with respect to the center axis C. 26*a* is a coil.

At a back side of the motor 26 in an extending direction Z of the center axis C, a circuit board 28 is placed and fixed to the base plate 16 by a screw 91. The circuit-board 28 has a cutout or an opening 31 in order to allow various large-components to be arranged therein, which can partially fit in the cutout or opening 31. The cutout or opening 31 includes a large, semicircular or approximately circular cutout 31*a* for allowing the button battery 27 to be arranged therein and an opening 31*c* for allowing the coil 26*a* to be arranged therein, in addition, includes a large arcuate-cutout 31*b* for allowing a later-described reception antenna 40 to be arranged therein.

At a side facing the back-cover 5 of the circuit board 28, circuit components such as a crystal oscillator 32 and a rotor IC 33 are mounted, and powered by the battery 27 to drive the motor 26 similarly powered by the battery 27 in order to rotate the pointers 18 via the train 22.

Near an outer circumferential edge of the base plate 16, a reception antenna 40 as the antenna structure that is generally arcuate is attached and fixed by a resin antenna frame 60 and a resin screw 62.

As shown in FIG. 1 and FIG. 2, in addition, FIG. 3, the antenna 40 has a magnetic core member 45 that is formed by piling thin leaves 43, 44 (each thickness is about 0.4 mm) on each other which are formed by piling plural sheets (for example, about 20 sheets, respectively) of foils 41 having larger length (for example, length of about 30 mm) and foils 42 having smaller length (for example, length of about 20 mm) as foils comprising a soft magnetic amorphous alloy (for example, width of about 0.8 mm and thickness of about 20 μm), and has a shape curved arcuately such that the thin leaf 44 comprising the foils 42 having the smaller length is situated at an outer circumferential side. The shorter thin-leaf 44 is disposed at the center in a longitudinal direction of the longer thin-leaf 43, and in the longer thin-leaf 43, both ends 46*a*, 46*b* (when they are not distinguished or named generically, expressed by a sign 46) project an equal distance from both ends 47*a*, 47*b* (when they are not distinguished or named generically, expressed by a sign 47) of the shorter thin-leaf 44. The thickness, number of laminated sheets, width, length and the like described herein are merely an example, and it is natural that they may be larger or smaller than those, respectively. While thickness of the thin leaves 43, 44 or the number of laminated sheets of the foils 41, 42 is same in this example respectively, it may be different from each other. In particular, at least three types of thin-leaves having different length each may be formed using at least three types of foils having different length each. While the ends 46*a*, 46*b* at both ends typically have the same size and shape, the shape or length of the ends 46*a*, 46*b* may be different from each other depending on the layout and other arrangement circumstances or types of adjacent components.

A wire 51 is wound many times on a center portion 48 of the magnetic core member 45 via an electrically insulative film 49 to form a coil 50.

The arcuately curved, magnetic core member 45 actually forms a circular arc with the center axis C as a center. Therefore, as shown in FIG. 2, a distance or an interval L1 between an outer circumferential surface 52 of the thin leaf 44 of the core magnetic member 45 and the circumferential surface 11 of the room 17 of the case 10 is substantially constant over full length of the core magnetic member 45. That is, since the core magnetic member 45 is arcuately curved, the core magnetic member 45 can be arranged in the case 10 with being close to the circumferential surface 11 such that at least minimum interval L1 required for allowing signal reception at a desired level is kept against the case 10, and an occupied space including the interval L1 is minimized. The interval is about several millimeters (for example, about 2 mm). However, it may be larger or smaller than this.

The exposed ends 53*a*, 53*b* (when they are not distinguished or named generically, expressed by a sign 53) of the magnetic core member 45 of the antenna 40, which is projected and exposed from both ends of the coil 50, configure ends for receiving an electric wave. The ends 53 comprise the ends 47 of the short thin-leaf 44, and a portion laminated on the ends 47 and protruding portions 46 of the long thin-leaf 43.

As known from FIG. 1C and FIG. 1D, the antenna frame 60 having a cross section of U-shape (reverse U-shape in the figure) is covered on respective exposed ends 53 of the magnetic core member 45. In inner and outer circumferential walls 63, 64 configuring legs of the U shape of the antenna frame 60, as known from FIG. 1A, the outer circumferential wall 64 has thick portions 65 that expand thick near the tips with respect to the ends 47 of the short thin-leaf 44 in the exposed ends 53 of the magnetic core member 45, and through-holes 66 (see FIG. 1D together) are formed in the thick portions 65. In this example, the thick portions 65 also expand radially outward in a mode of using the gap having the length of L1 to secure a screwing area.

Resin screw pins 68 inserted from recesses 67 at the back side of the base plate 16 are inserted into the through-holes 66, and the screws 62 are screwed in screw holes 69 opened at tips of the screw pins 68.

Accordingly, the magnetic core member 45 is fixed to the base plate 16 in a condition of using narrow spaces.

In the antenna 40, since the exposed ends 53 of the magnetic core member 45 do not have the thin leaf 44 in the tip portions 46 where magnetic flux tends to spread, an outer surfaces 54 of the tip portions 46 of the exposed ends 53 can be situated a distance L2 (>L1) distant from the inner circumferential surface of the case 10, therefore possibility of obstructed reception of an electric wave by presence of the case 10 is reduced, consequently reception sensibility of the electric wave can be improved. Moreover, since the case 10 may not largely affect the tip portions 46 of the ends 53 is low, the tip portion 46 can be lengthened to receive the electric wave in a wider area, consequently sensitivity is easily improved. Furthermore, since L1 can be minimized with a desired interval as L2 being secured, a gap between the antenna 40 and the case 10 can be minimized, and the occupied space including the gap can be suppressed to a minimum.

The outer surface 52 is connected to the outer surface 54 via a slope 55 comprising edges of the laminated foils 41, and a slope 56 comprising edges of the laminated foils 42 is formed at an edge of the outer surface 54. Accordingly, the outer surfaces 52, 55, 54 and 56 in all form an outer circumferential surface extending non-arcuately such that it is situated at more inner circumference side as it approaches the tip.

In the above, when the dial plate 15 comprises resin, the back cover 5 may comprises nonmagnetic metal, and in some cases, both may comprises nonmagnetic metal. Naturally, both may comprises resin.

Moreover, for example, the screw 62 may be formed from nonmagnetic metal material instead of forming both of the screw 62 and the screw pin 68 from resin. Here, in the screw 62, for example, diameter of a head is about 1.5 mm, and diameter of a shaft is about 0.7 mm. However, each of them may be larger or smaller than that.

The wave clock 1 further has a detection part 70 of a time signal, which comprises a detection IC 71 of a received, electric wave, a crystal oscillator 72 and the like, and thereby draws out time information in a standard electric wave received by the antenna 40, and then under control of a time adjustment controller (not shown), controls rotational drive of the motor 26 to adjust time indicated by the pointers 18.

In the wave clock 1, since sensitivity of the antenna 40 can be improved, even in an area where the standard electric wave is comparatively weak, or the interior of a building where an electric wave tends to weaken and the like, the standard electric wave can be received more securely to correct the time indicated by the pointers.

The reception antenna 40 configured as above is preferably fabricated as follows.

Figure 5A:
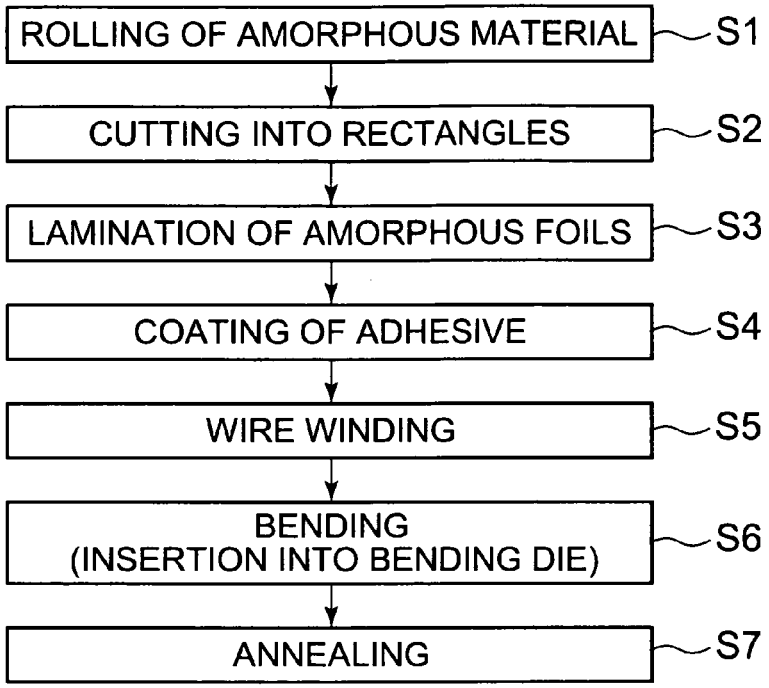
FIG. 5A is a flowchart of fabrication procedure of the magnetic core member of FIG. 1 to FIG. 3.

That is, as shown as a fabrication method or a fabrication process P1 in FIG. 5A, first an amorphous material sheet is prepared (step S1), then the sheet is cut into rectangles to form long foils 41 and short foils 42 (step S2), and then each of foils are laminated to form a long thin-leaf 43 and a short thin-leaf 44 and a laminated body of them (body of the magnetic core member 45) (step S3), and then an adhesive is coated and the electrically insulative film 49 is covered over the central portion 48 of the laminated body 45 (step S4), and then the wire 51 is wound on the film 49 to form the coil 50 and thus an antenna body is formed (step S5), and furthermore arcuate bending is performed to the antenna body (step S6), and finally annealing is performed by heating the object to be processed to desired temperature in accordance with the object and holding the object in the temperature region for a desired period and then gradually lowering the temperature while the object is held to be bent (step S7).

In the annealing step S7, on one hand, by curing the adhesive, the many foils 41, 42 and the thin leaves 43, 44 comprising the foils, which configure the magnetic core member 45, are integrally bonded and fixed in an arcuately curved form, and the coil 50 is actually fixed to the magnetic core member in a condition of being arcuately curved along the arcuately curved magnetic core member; on the other hand, magnetic characteristics that were deteriorated due to strain occurring in the soft magnetic, amorphous material during the rolling and cutting processes are recovered. That is, in the annealing process S7, both of the fixing and stabilization of the shape of the antenna 40 formed by arcuately curving the magnetic core member 45 and the coil 50 and recovery of the soft magnetic characteristics of the soft magnetic material configuring the magnetic core member 45 are achieved at the same time.

If desired, the steps S3 and S4 may be performed actually at the same time by laminating the foils 41, 42 while the adhesive is coated so that the adhesive uniformly lies between adjacent foils 41 and 41, or foils 41 and 42, or foils 42 and 42.

Moreover, in the method P1, since the straight antenna body is formed, and then the body is curved to form the arcuate antenna, a condition that the wire 51 configuring the coil 50 is wound comparatively evenly in a direction approximately corresponding to a radial direction of the circular arc can be realized. That is, if a wire is tried to be wound in a coil pattern on a magnetic core member that has been curved arcuately, uniform winding along the circular arc is hardly achieved, and leakage of magnetic flux easily occurs at an uneven winding portion, on the contrary, in the method P1, such a problem can be suppressed to a minimum.

In the above, it is acceptable that the thermosetting adhesive has been coated even on the coil 50 so that the wire 51 of the coil 50 is integrally firmed during annealing.

The bending step S6 typically comprises forcing the antenna body into the bending die. The antenna body is annealed with being held in the bending die; thereby desired curing and annealing can be performed.

In the step S1, the amorphous material sheet is formed, for example, by a liquid quenching method using a roll. However, any other method may be used to prepare the sheet, and if possible, rolling may be used.

Here, when the method is compared to a fabrication method PA1 of a rod antenna comprising conventional manufacturing procedure (FIG. 5C) of a straight rod antenna Sa1, Sa2, Sa3, Sa4, Sa5 and Sa6, the steps S1 to S4 are same as conventional steps Sa1 to Sa4 except that the rectangular amorphous foils have at least two types of length. They are different in that while the wire is wound (step Sa6) after the annealing step sa5 in the conventional method PA1, in the method P1 of the example, annealing is performed (step S7) after the wire winding step S5, and the bending step S6 is added after the wire winding step S5 and before the annealing step S7.

Figure 4:
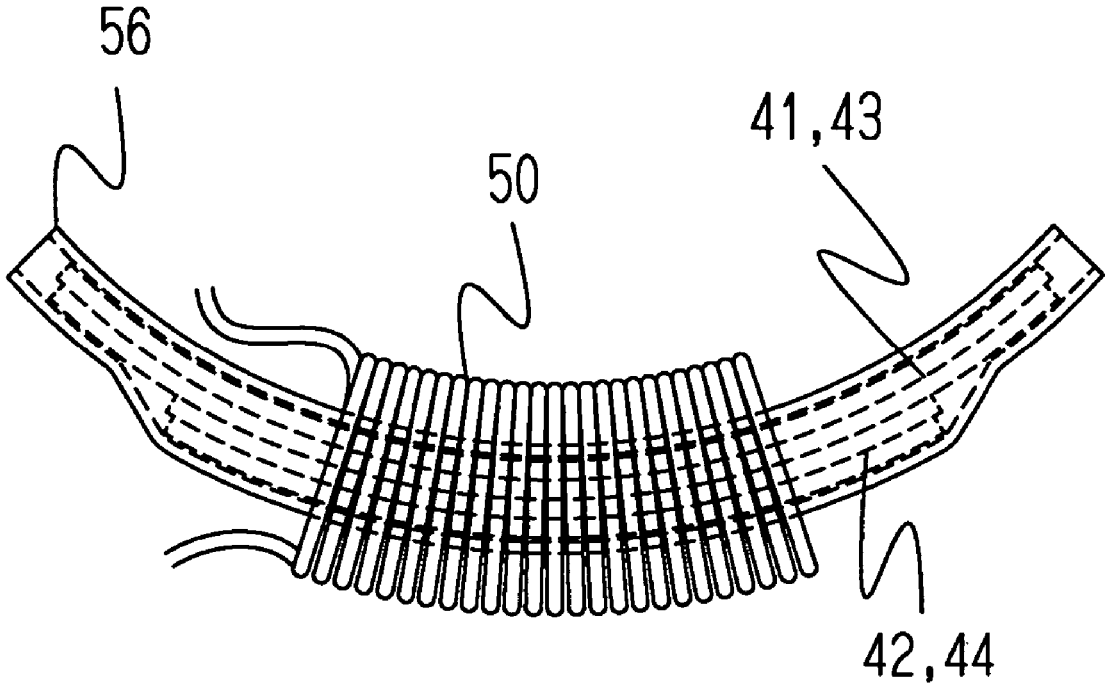
FIG. 4 is a plane, explanatory drawing of a magnetic core member of a modification.

Instead of wrapping (covering) the electrically insulative film 49 over the laminated body, as shown in FIG. 4, a resin tube 56 that is electrically insulative and thermally shrinkable may be covered over the laminated body 45.

In that case, the thermally shrinkable tube 56 is made to have a length larger than the short foils 42 and the short thin-leaf 44, in addition, for example as shown in FIG. 4, made to have a length approximately equal to or slightly longer than length of the long foils 41 and the long thin-leaf 43, thereby the magnetic core member 45 comprising the curved, laminated body can be stably integrated and held.

Figure 5B:
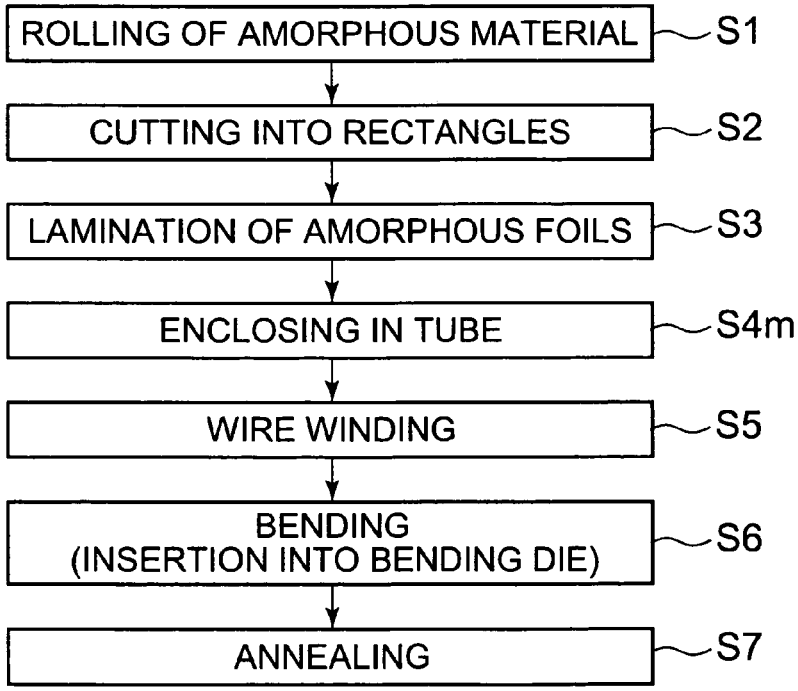
FIG. 5B is a flowchart of fabrication procedure of the magnetic core member of FIG. 4.
Figure 5C:
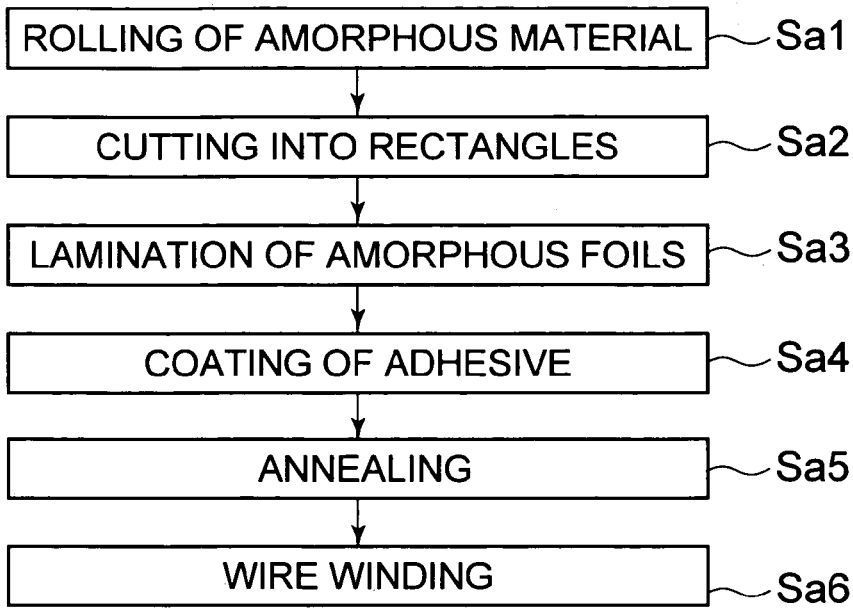
FIG. 5C is a flowchart for comparison on a conventional magnetic core member shown by a similar procedure to FIG. 5A.

When such a thermally shrinkable tube 56 is used, as shown as a fabrication process P2 of which the procedure is shown in FIG. 5B, the procedure is similar to FIG. 5A except that the adhesive coating step S4 of the procedure FIG. 5A is substituted by the insertion step S4*m* into the tube 56. However, in the annealing step of step S7, this case is different in that integration of the magnetic core member 45 by thermal shrinkage of the thermally shrinkable tube 56 is performed instead of integration of the magnetic core member 45 by curing of the adhesive. Again in this case, it is acceptable that the thermosetting adhesive has been coated even on the coil 50 so that the wire 51 of the coil 50 is integrally firmed during annealing.

Figure 5D:
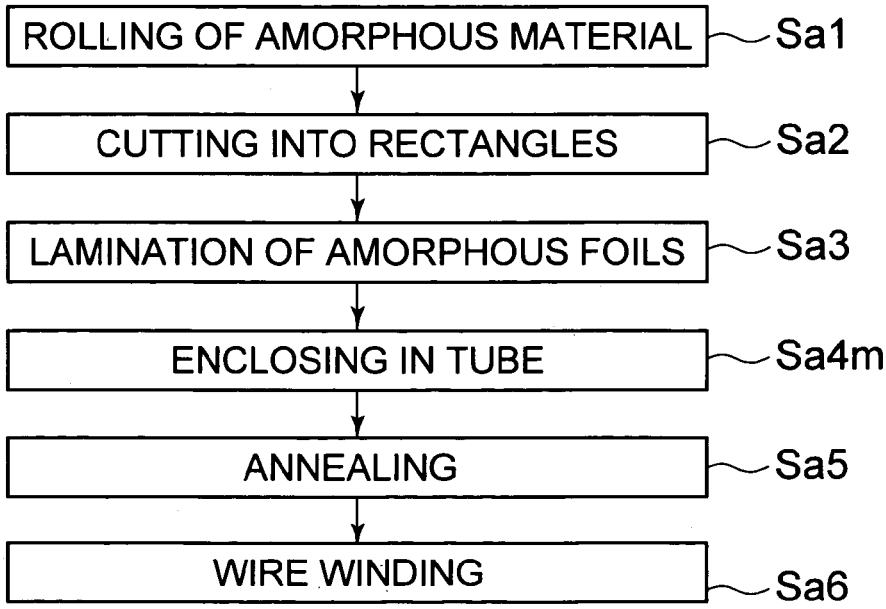
FIG. 5D is a flowchart for comparison on another conventional magnetic core member shown by a similar procedure to FIG. 5B.

Difference between the procedure or method P2 of FIG. 5B and a fabrication method PA2 of the rod antenna comprising conventional procedure Sa1, Sa2, Sa3, Sa4*m*, Sa5 and Sa6 shown in FIG. 5D is same as difference between the methods P1 and PA1. However, the method P2 of FIG. 5B is different in that holding power by the thermally shrinkable tube 56 can be effectively used for holding and integration of the actually curved, laminated body 45 having different kinds of length, rather than simple holding of a straight laminated-body.

What is claimed is:

1. An antenna structure being received in a case comprising:

an arcuately curved, soft magnetic, magnetic core member; and a coil wound on the center in an extending direction of the magnetic core member;

wherein the magnetic core member has an outer circumferential surface at at least one of ends exposed from the coil, the surface extending non-arcuately such that it is situated at more inner circumferential side as it approaches a tip.

2. An antenna structure according to claim 1, wherein the arcuately curved, magnetic core member is formed by laminating plural sheets of soft magnetic, thin leaves, and the soft magnetic, thin leaf at an inner circumferential side is large in circumferential length compared with the soft magnetic, thin leaf at an outer circumferential side.

3. An antenna structure according to claim 2, wherein each of the soft magnetic, thin leaves is formed by laminating plural sheets of soft magnetic foils.

4. An antenna structure according to claim 1, wherein the soft magnetic member comprises an amorphous soft magnetic material.

5. An antenna structure according to claim 1, wherein the antenna structure is an antenna for a wave clock.

6. A wave clock having the antenna structure according to claim 4.

7. A method for manufacturing an antenna structure comprising, forming a laminated body by piling soft magnetic, thin leaves having different length each, forming a coil by winding a wire at the center in a longitudinal direction of the laminated body, arcuately curving the laminated body such that a thin leaf having smaller length is situated at an outer circumferential side, and annealing the curved, laminated body.

8. An method for manufacturing an antenna structure according to claim 7, wherein the wire is wound after the laminated body is enclosed in an electrically insulative tube.

9. An method for manufacturing an antenna structure according to claim 7, wherein the wire is wound after an electrically insulative adhesive is coated on the laminated body.

* * * * *